US007381947B2

(12) United States Patent
Senko

(10) Patent No.: US 7,381,947 B2
(45) Date of Patent: Jun. 3, 2008

(54) ELECTRODE NETWORKS FOR PARALLEL ION TRAPS

(75) Inventor: Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 84 days.

(21) Appl. No.: 11/429,612

(22) Filed: May 5, 2006

(65) Prior Publication Data

US 2008/0067362 A1 Mar. 20, 2008

(51) Int. Cl.
*H01J 49/42* (2006.01)

(52) U.S. Cl. ..... 250/292

(58) Field of Classification Search ..... None
See application file for complete search history.

(56) References Cited

U.S. PATENT DOCUMENTS 4,755,670 A * 7/1988 Syka et al. ..... 250/292
5,206,506 A 4/1993 Kirchner
5,401,962 A * 3/1995 Ferran ..... 250/292
5,420,425 A * 5/1995 Bier et al. ..... 250/292
6,762,406 B2 7/2004 Cooks et al.
6,838,666 B2 1/2005 Ouyang et al.
7,157,699 B2 * 1/2007 Ouyang et al. ..... 250/281
7,217,919 B2 * 5/2007 Boyle et al. ..... 250/285
2006/0091308 A1 5/2006 Boyle et al.
2007/0075239 A1 * 4/2007 Ding et al. ..... 250/282

FOREIGN PATENT DOCUMENTS

WO WO 2004/109743 A2 12/2004

* cited by examiner

*Primary Examiner*—Jack I Berman
(74) *Attorney, Agent, or Firm*—Dorsey & Whitney LLP; Sharon Upham; Michael C. Staggs

(57) ABSTRACT

An electrode network for N parallel ion traps, wherein N is an integer larger than 1, includes at most 2N+2 electrodes, which form N trapping volumes each corresponding to a respective one of the N parallel ion traps. Also provided is a parallel mass spectrometer, comprising: a vacuum chamber and a network of at most 2N+2 electrodes disposed in the vacuum chamber and held in fixed positions with respect to each other, the network of electrodes forming N trapping volumes each corresponding one of N parallel ion traps. The network of electrodes may be arranged in first and second rows of electrodes. A plurality of detectors is positioned to receive ions ejected from the trapping volumes through spaces between adjacent electrodes in the first row of electrodes.

15 Claims, 9 Drawing Sheets

ELECTRODE NETWORKS FOR PARALLEL ION TRAPS

FIELD OF THE INVENTION

The present invention relates in general to mass spectrometry using ion traps, and more particularly to an electrode network for parallel ion traps.

BACKGROUND OF THE INVENTION

Ion traps have been used for the study of spectroscopic and other physical properties of ions. Linear ion traps, in which ions are confined radially by a two-dimensional radio frequency (RF) field and axially by stopping potentials applied to end electrodes, are rapidly finding new applications in many areas of mass spectrometry. In U.S. Pat. No. 4,755,670, Syka and Fies have described the theoretical advantages of 2-D versus 3-D quadrupole ion traps for Fourier transform mass spectrometry. These advantages include reduced space charge effects due to the increased ion storage volume, and enhanced sensitivity for externally injected ions due to higher trapping efficiencies.

Recently, there has been a significant amount of work performed on techniques for increasing sample throughput for mass spectrometers. Currently, the most commercially popular technique is through serial multiplexing, where a modified ion source with multiple independent sprayers is used and a mechanical mask blocks all but one of the sprayers at a time. The mask switches sequentially from sprayer to sprayer to acquire mass spectra from each sample in a serial fashion. The primary disadvantage of the serial multiplexing technique is the reduced sampling rate for each sample. For example, with a four-sprayer ion source, each sprayer is sampled at a rate that is 4 times slower than that of a standard instrument.

Accordingly, further developments in the field are needed.

SUMMARY

The present invention relates in general to mass spectrometry using ion traps, and more particularly to an electrode network for parallel ion traps. Embodiments of the electrode network provides a large number of ion storage and manipulation regions, while employing a minimum number of electrodes. Additionally, embodiments of the electrode network enables one to simultaneously analyze two or more samples in adjacent traps independent of one another.

Embodiments of the present invention comprise an electrode network for N parallel ion traps, wherein N is an integer larger than 1, characterized in that the electrode network includes at most 2N+2 electrodes, which form N trapping volumes each corresponding to a respective one of the N parallel ion traps.

In other embodiments of the present invention, a parallel mass spectrometer is provided, comprising: a vacuum chamber and a network of at most 2N+2 electrodes disposed in the vacuum chamber and held in fixed positions with respect to each other, the network of electrodes forming N trapping volumes each corresponding one of N parallel ion traps. In some embodiments, the network of electrodes are arranged in first and second rows of electrodes, and the parallel mass spectrometer further comprises a plurality of detectors positioned to receive ions ejected from the trapping volumes through spaces between adjacent electrodes in the first row of electrodes.

Embodiments of the present invention further comprise a method for operating the N parallel ion traps constructed using the electrode network. In some embodiments, the method comprises scanning the mass range backwards, instead of forward to resonantly eject ions through the gap between the rods, In additional embodiments, the method comprises the steps of: selecting a first mass range; determining a first RF voltage range based on the first mass range, the first RF voltage range having a first higher RF voltage limit and a first lower RF voltage limit; scanning the RF voltage outputs from the first higher RF voltage limit to the first lower RF voltage limit to eject ions within the first mass range from the trapping volumes through at least some of the spaces; selecting a second mass range different from the first mass range; determining a second RF voltage range based on the second mass range, the second RF voltage range having a second higher RF voltage limit and a second lower RF voltage limit; and scanning the RF voltage outputs from the second higher RF voltage limit to the second lower RF voltage limit to eject ions within the second mass range from the trapping volumes through at least some of the spaces.

DETAILED DESCRIPTION

Figure 1A:
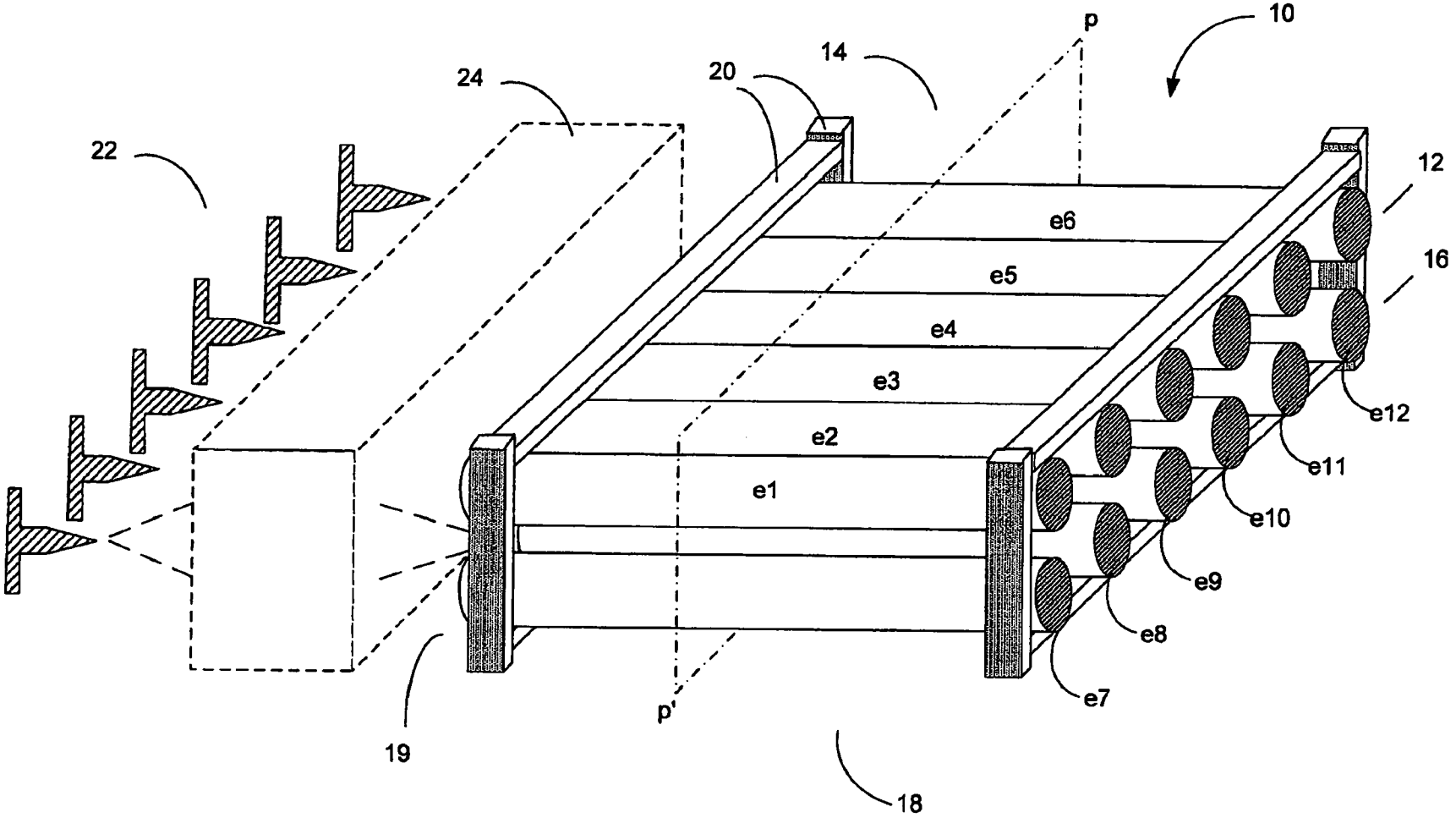
FIG. 1A is a three-dimensional view of an electrode network for parallel ion traps according to one embodiment of the present invention.

Embodiments of the present invention comprise an electrode network in a multiplexed system of up to N parallel ion traps, where N is an integer larger than one. The electrode network includes at most 2N+2 electrodes forming N trapping volumes each corresponding to a respective one of the N parallel ion traps. FIG. 1A is a three-dimensional view of an electrode network 10 according to one embodiment of the present invention. As shown in FIG. 1A, with N=5 as an example, electrode network 10 includes 2N+2 (e.g., 12) electrodes $e_1, e_2, \ldots, e_{12}$ arranged in two rows each having N+1 (e.g., 6) electrodes. The two rows of electrodes include a first row 12 having electrodes $e_1, e_2, \ldots, e_6$ on a first side 14 of the electrode network 10, and a second row 16 having electrodes $e_7, e_8, \ldots, e_{12}$ on a second side 18 of the electrode network 10. In one embodiment, each electrode in the electrode network 10 is made of a conductive material and has a rod-like shape. The electrodes $e_1, e_2, \ldots, e_{12}$ in the electrode network 10 may be fastened to solid bars or frames 20 at or near either or both of their ends so their positions are fixed with respect to each other.

Figure 1B:
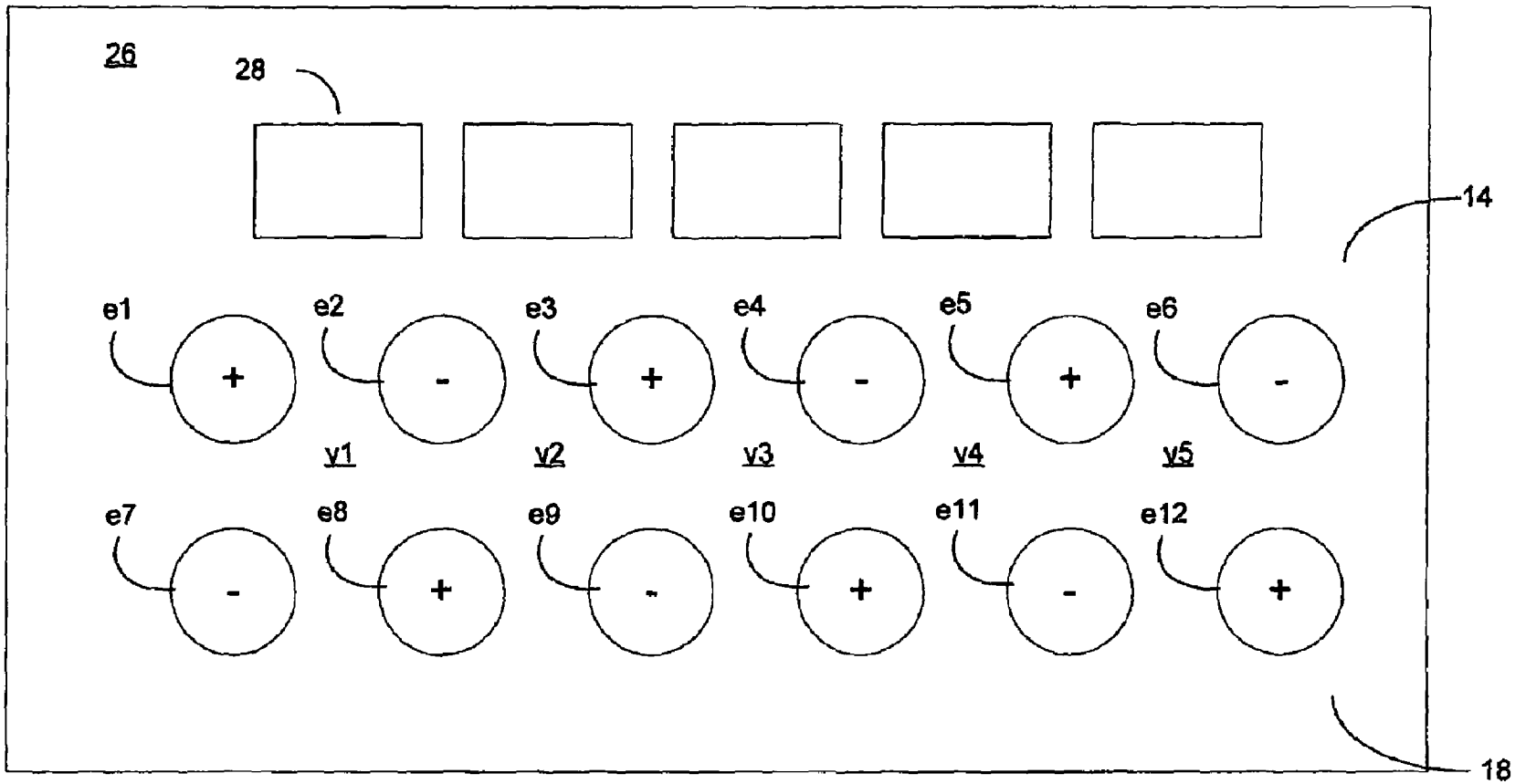
FIG. 1B is a cross-sectional view of the electrode network according to one embodiment of the present invention.

An ion source 22 such as electron impact (EI), electrospray, or matrix-assisted laser desorption (MALDI) ionization (not shown) may be provided for each of the trapping volumes $v_1$ through $v_5$ (which are shown in FIG. 1B) As illustrated in FIG. 1A, ion source 22 is comprised of an array of sources, and ions from each source are focused using one of a set of conventional electrostatic and/or electrodynamic lensing systems 24 into the corresponding ion trap from one end 19 of the electrode network 10. As an example, the lensing system described by Schwartz and Senko in "A Two-Dimensional Quadrupole Ion Trap Mass Spectrometer," J. Am. Soc. Mass Spectrom. 2002, 13, 659-669, the entirety of which is incorporated herein by reference, can be used as one of the set of lensing systems 24.

FIG. 1B is a cross-sectional view of the electrode network 10 taken across a virtual middle plane p' of the electrode network according to one embodiment of the present invention. As shown in FIG. 1B, every four adjacent electrodes in the electrode network 10 form a trapping volume, which provides an ion trap. For example, electrodes $e_1$, $e_2$, $e_7$, and $e_8$ form a trapping volume $v_1$, electrodes $e_2$, $e_3$, $e_8$, and $e_9$ form a trapping volume $v_2$, electrodes $e_3$, $e_4$, $e_9$, and $e_{10}$ form a trapping volume $v_3$, electrodes $e_4$, $e_5$, $e_{10}$, and $e_{11}$, forming a trapping volume $v_4$, and electrodes $e_5$, $e_6$, $e_{11}$, and $e_{12}$ form a trapping volume $v_5$. Therefore, up to five parallel ion traps or analyzers can be constructed using the electrode network 10 illustrated in FIGS. 1A and 1B. While five parallel ion traps are illustrated, the invention is not limited to this configuration, and other configurations may be employed.

The electrode network 10 can be placed in a vacuum chamber 26, which may be filled with a damping gas (e.g., helium, argon, hydrogen, nitrogen, etc.) to a pressure of about 1-10 mtorr. Collisions with the damping gas in the vacuum chamber 26 dampens the kinetic energy of the ions and serve to quickly contract trajectories toward the center of a trapping volume. In one embodiment, two phases of a primary RF voltage (in one example, an RF voltage with a peak voltage of about ±5 kV and a frequency of about 1 MHz) are selectively applied to the electrodes in the electrode network 10 to produce a radial trapping field for each of the trapping volumes $v_1$ through $v_5$.

In one embodiment, ions trapped in each of the trapping volumes $v_1$ through $v_5$ can be ejected through spaces or gaps between the electrodes on either or both sides of the trapping volume. For example, ions trapped in the trapping volume $v_1$ can be ejected through a gap between electrodes $e_1$ and $e_2$, and/or through a gap between electrodes $e_7$, and $e_8$. Likewise, ions trapped in the trapping volume $v_2$ can be ejected through a gap between electrodes $e_2$ and $e_3$, and/or through a gap between electrodes $e_8$ and $e_9$, and so forth.

Figure 1C:
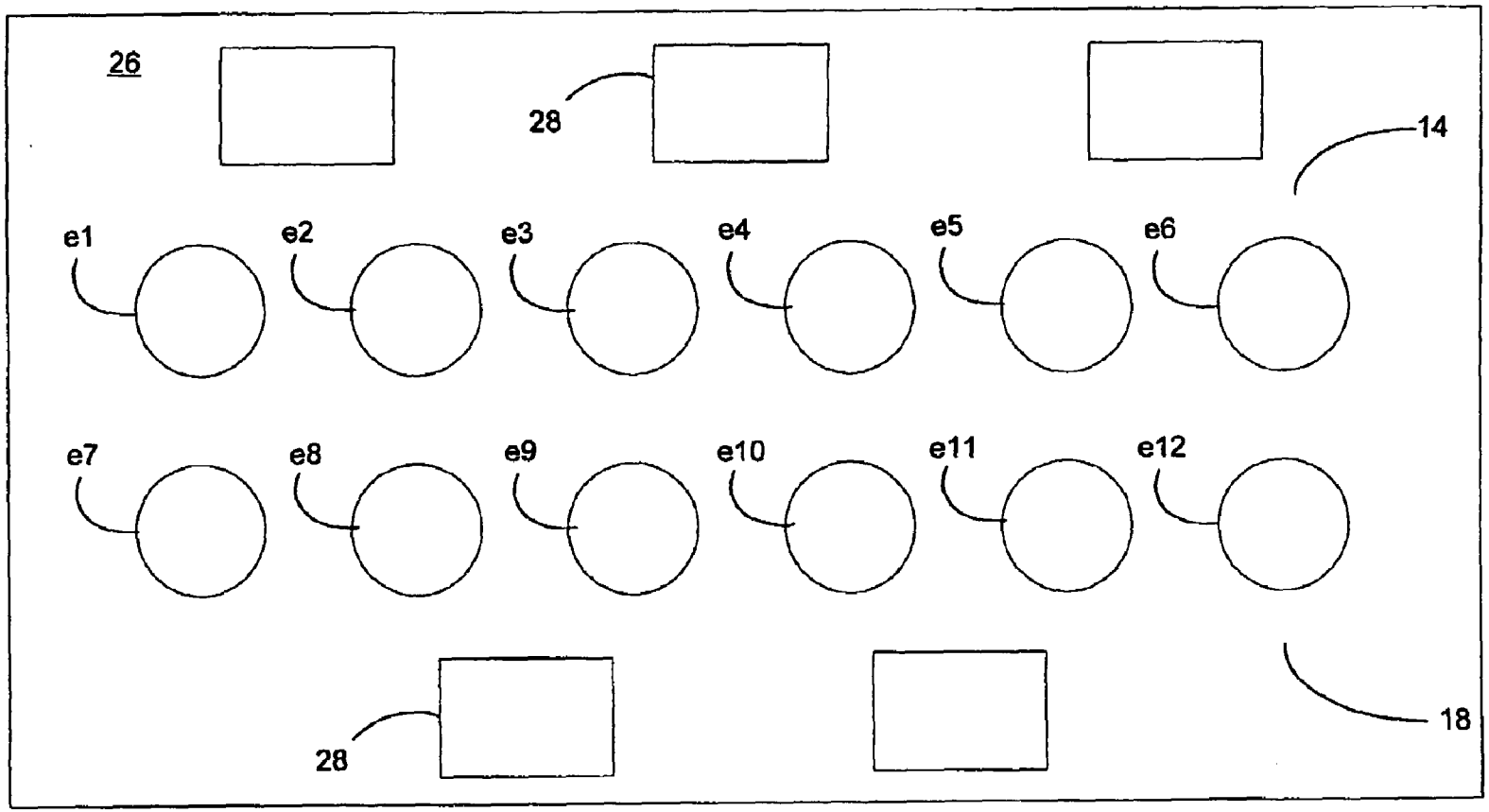
FIG. 1C is a cross-sectional view of the electrode network according to an alternative embodiment of the present invention.

One or more detectors 28 placed on either or both sides 14 and 18 of the electrode network 10 can be used to detect ions ejected from each of the trapping volumes $v_1$ through $v_5$. There is no need however, for dual detectors for each analyzer, as normally used with linear ion traps known in the prior art. The inventor has determined that external extraction voltages produce efficient collection of ions with a single detector for each of the parallel ion analyzers constructed using the electrode network 10. So, all of the detectors 28 can be on one side of the electrode network 10, as shown in FIG. 1B. For smaller analyzers, it might be desirable to alternate the location of the detectors on the two sides of the electrode network 10, as shown in FIG. 1C.

Figure 2:
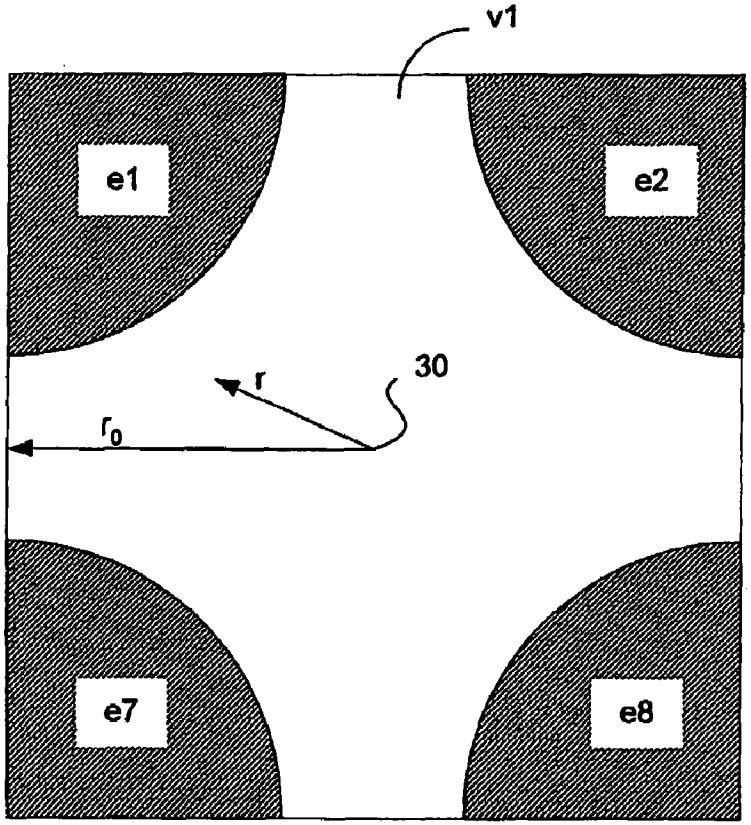
FIG. 2 is a cross-sectional view of a trapping volume formed by four adjacent electrodes in the electrode network according to one embodiment of the present invention.

FIG. 2 illustrates a cross-sectional view of one of the trapping volumes $v_1$ through $v_5$ with only a quarter of each of the electrodes forming the trapping volume shown. Trapped ions are focused toward the center 30 of the trapping volume by the oscillating potential from the two phases of the primary RF voltage. An ion in each trapping volume would be stably trapped depending upon the mass (m) and charge (e) of the ion, the size of the trapping volume measured in radius ($r_0$) from the center of the trapping volume, the oscillating frequency ($\omega$) of the primary RF, and the amplitude (V) of the primary RF voltage. A dimensionless parameter $q_r=4\ eV/mr_0^2\omega^2$ can be used to determine whether ions of a particular mass-to-charge ratio would have stable trajectories in an ion trap of a particular configuration. Thus, the amplitude of the primary RF voltage determines the range of m/z values that can be trapped.

There are several problems with ejecting the ions through the gaps between the electrodes. One of the problems is that the primary trapping field is strongest in the gaps, so the ions are more likely to hit an electrode than to pass through the gap to an external detector. A second problem is that a dipole field used for ejection becomes close to zero in the gap between rods, so the ions may stall at a critical time during the ejection process. A third problem is that the field in a trapping volume does not increase linearly with displacement (r) from the center 30 of the volume, as it would with a perfect quadrupolar potential. Because the electrode rods have a finite dimension, there will be a negative octopolar component associated with the existence of the gaps, similar to the effect of holes in an end cap of a 3D trap, or slots in the electrodes of a conventional linear ion trap.

Figure 3:
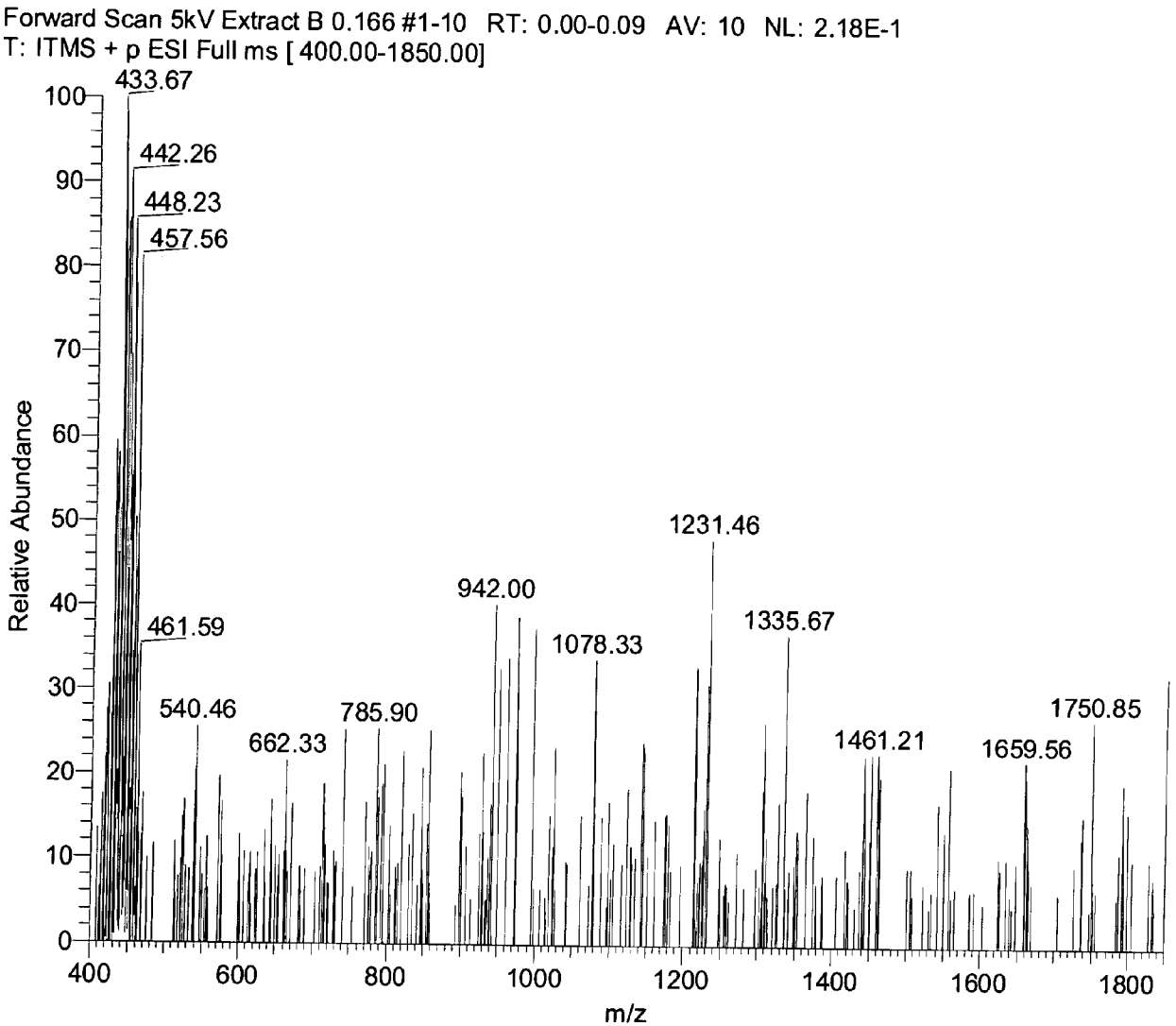
FIGS. 3 and 4 illustrate respectively graphs of relative abundance vs. mass-to-charge ratio obtained by using forward and reverse scans.
Figure 4:
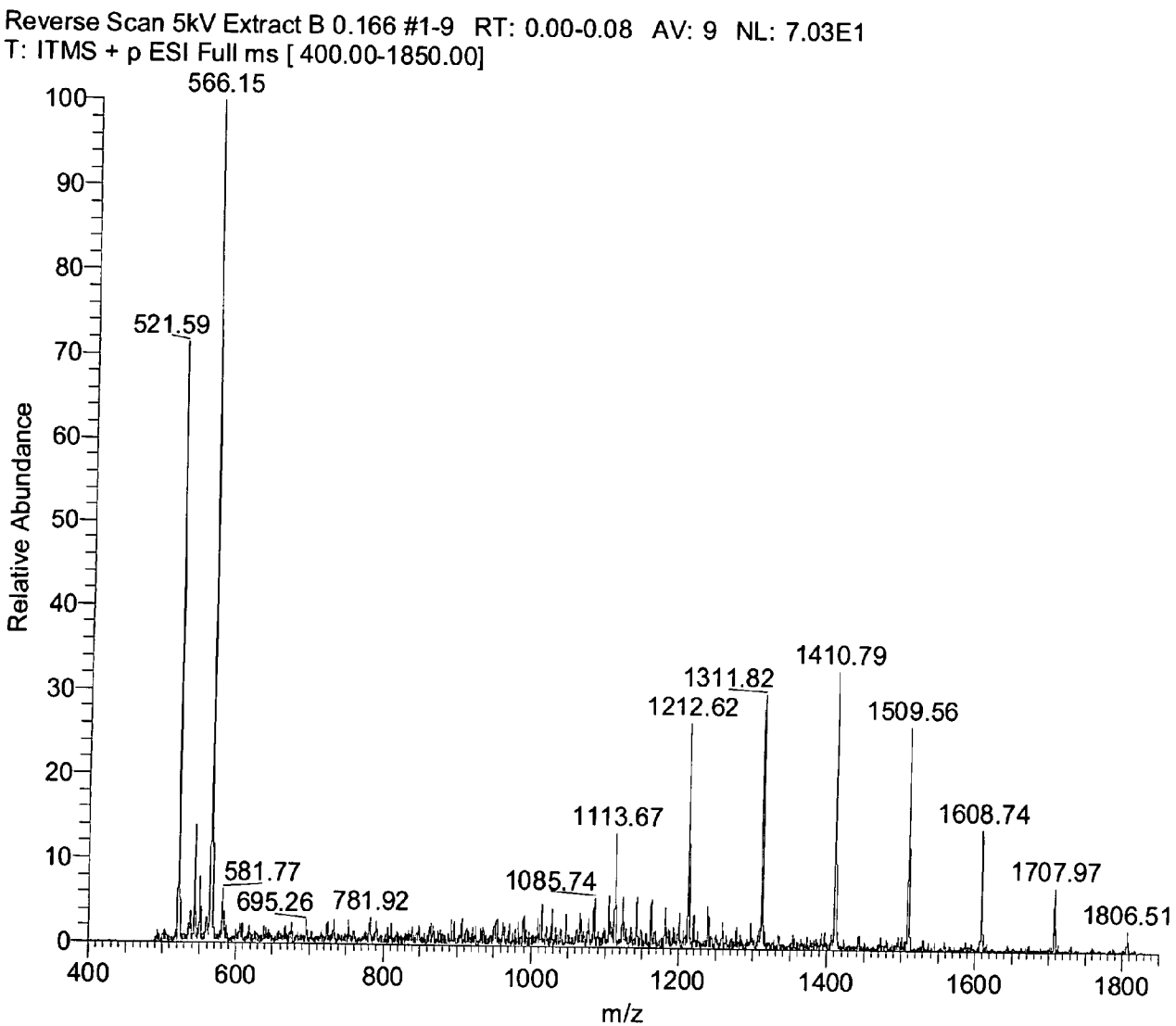

The inventor has discovered that when attempting to resonantly eject ions through the gap between the rods, scanning the mass range backwards, instead of forward, helps to overcome some of the problems associated with the negative octopole component. FIGS. 3 and 4 illustrate graphs of relative abundance vs. mass-to-charge ratio (m/z) obtained by using forward (or upward) and reverse (or downward) scans, respectively. With the forward scan, the graph in FIG. 3 shows almost no meaningful results except a minor initial burst of ions at low m/z. In comparison, the graph from the reverse scan in FIG. 4 provides a recognizable set of peaks. In the reverse scan, ions move towards resonance during the ejection process, while for the forward scan, ions move away from resonance, making ejection less efficient.

Figure 5:
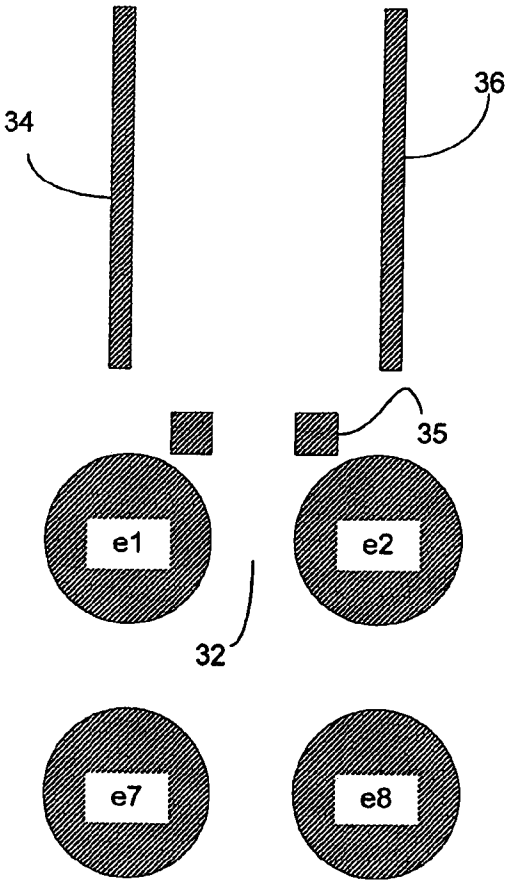
FIG. 5 is a block diagram illustrating a set up for ejecting ions through a gap between two electrodes in the electrode network using a −15 kV dynode and a grounded shield, according to one embodiment of the present invention.

FIG. 5 illustrates a system for ejecting ions through a gap 32 between two electrodes $e_1$ and $e_2$ in the electrode network 10. In the illustrative embodiment, detector 28 is positioned adjacent the electrodes and generally includes dynode 34 and multiplier 36. An electrometer (not shown) may also be provided to measure the output of the electron multiplier 36. In one embodiment, the detector employs a −15 kV dynode 34 and a grounded shield 35. The dynode 34 converts ions to electrons or other charged particles which are more compatible with the electron multiplier. The multiplier 36, positioned opposite to the dynode 34, receives the charged particles from the dynode 34 and produces approximately $1\times10^5$ electrons for each charged particle it receives. With −15 kV applied to the dynode, there is sufficient penetration of the voltage through the shield 35 and into the trap to produce 100% efficient ejection and detection. All ions eject preferentially towards the detector 28. Using a downward scan as before, reasonable peaks in simulation results can be obtained using ~10 V/msec RF scan rate, or 10 Kamu/sec mass scan rate, and a background damping gas of helium at a pressure of about 1 mtorr. In one embodiment of the present invention, each electrode in the electrode network 10 has a cross section with a substantially round shape, at least on the side facing a trapping volume, in order to provide sufficient gap between the electrodes for gap ejection. In alternative embodiments of the present invention, each electrode in the electrode network 10 has a cross section with a substantially hyperbolic shape on at least one side facing a trapping volume. Although the effective gap between round rods is much larger than that between hyperbolic rods, hyperbolic rods may still provide improved ejection performance because they produce less non-quadrupolar components in the trapping fields. Simulations have been run to look at the non-quadrupolar nature of round verses hyperbolic rods with different asymtote lengths, and the results of these indicate that hyperbolic rods may perform better than round rods for asymptotes which extend for a limited distance (e.g., $1.75r_0$). Going out farther than this with the asymptotes does not appear to improve the quality of the trapping field, but does increase the loss of ions due to the narrower gap between hyperbolic rods as compared to round rods.

Figure 6:
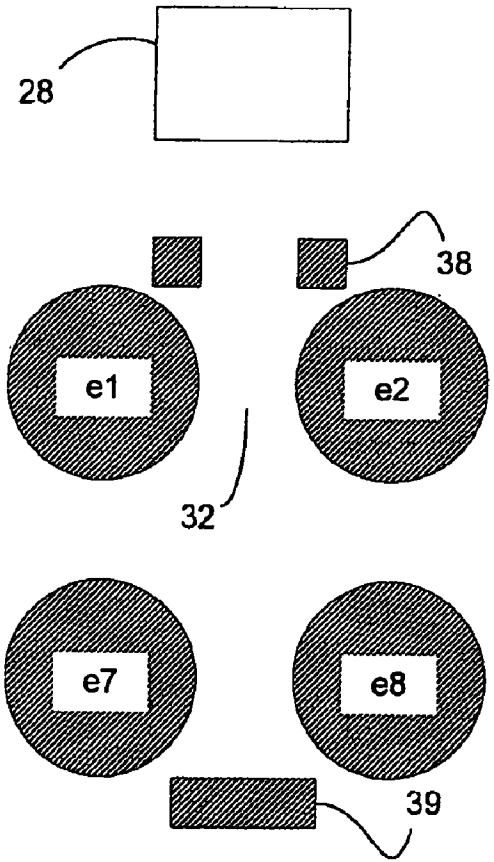
FIG. 6 is a block diagram showing that extraction lens can be provided to improve ejection of ions through gaps between electrodes, according to one embodiment of the present invention.

In one embodiment of the present invention, extraction lens 38 together with a repeller 39 can be provided to improve ejection of ions through the gaps, as shown in FIG. 6, where only electrodes associated with one trapping volume are shown. In one example, using a voltage in the range between 2-5 kV (negative polarity for positive ions) on the lens 38, close to unit resolution can be obtained, and the improvement is most noticeable at high m/z. For optimal results, the lens 38 should be made to provide a uniform extraction field. In an illustrative embodiment, the lens 38 has a 2 mm aperture. With the extraction lens 38, the peak shapes are improved, and near unit resolution can be obtained scanning ejecting at a q of 0.23 with a scan rate of 16.6 kamu/sec.

With the reverse scan, there may be problems with catching ions with low m/z values, because these ions can be unstable at the initially high RF voltage. However, a full range of m/z values of interest may be covered by limiting the m/z range for each scan and using multiple scans to cover different m/z ranges. In one embodiment, the m/z range for each scan is limited such that a lower limit $m_1$ and a higher limit $m_2$ of the m/z range are within a factor of three of each other, i.e., $m_2<3\cdot m_1$, or $m_1>\frac{1}{3}m_2$. In one embodiment, to scan across a range of m/z values greater than allowed by the above constraint, a first m/z range satisfying the above constraint is selected, and a first amplitude range for the primary RF voltage is computed based on the first m/z range. The first amplitude range has a first higher RF voltage limit and a first lower RF voltage limit. The amplitude of the primary RF voltage is first scanned downward from the first higher RF voltage limit to the first lower RF voltage limit to eject ions in the first m/z range.

After the first scan, the ion traps are filled with ions again, and a second m/z range satisfying the $m_2<3\cdot m_1$ or $m_1>\frac{1}{3}m_2$ constraint is selected. A second amplitude range for the primary RF voltage is computed based on the second m/z range and the amplitude of the primary RF voltage is then scanned downward from the second higher RF voltage limit to the second lower RF voltage limit to eject ions in the second m/z range. Further scans may be performed until the original range of m/z values greater than allowed by the above constraint is fully covered.

Figure 7:
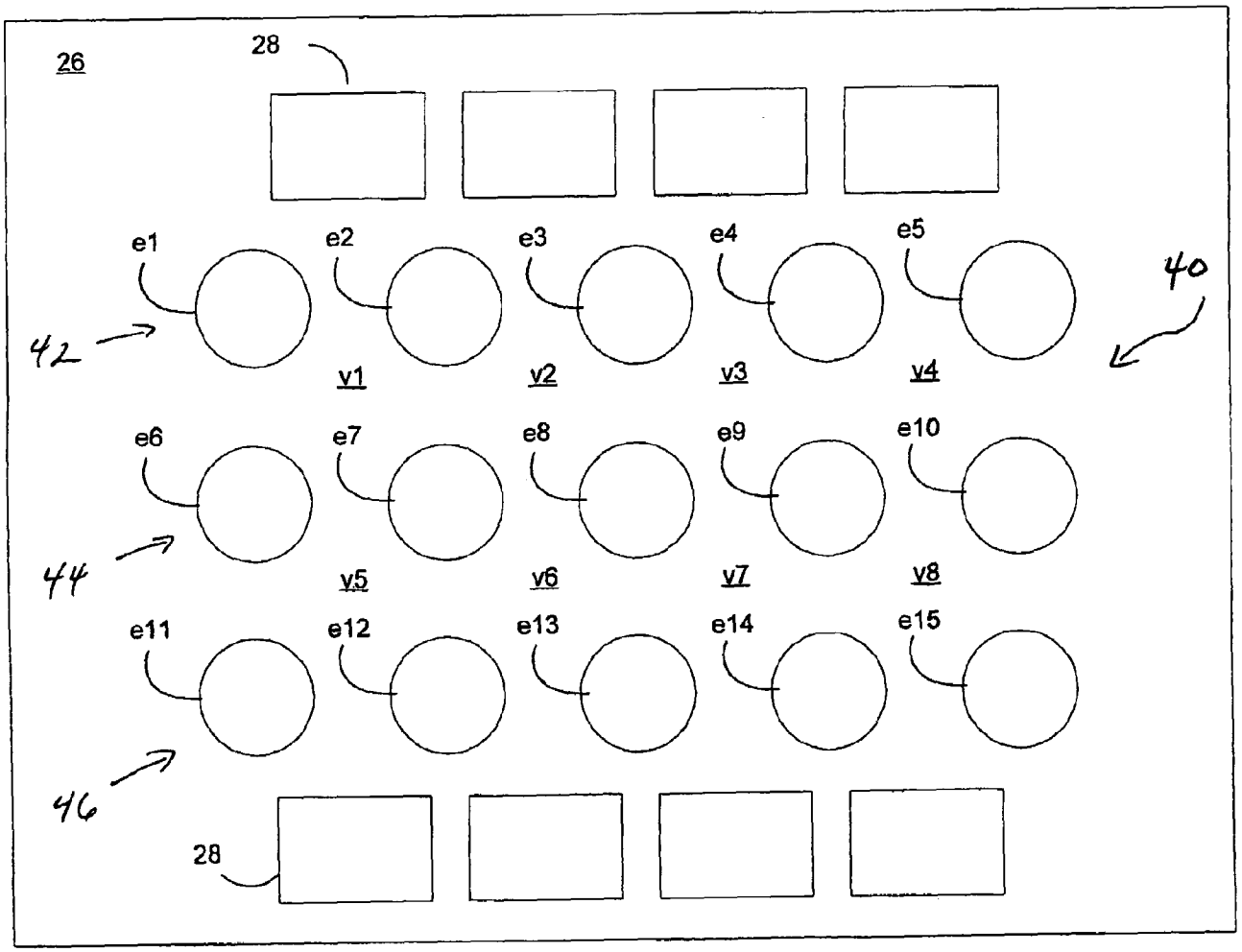
FIG. 7 is a cross-sectional view of an electrode network according to another embodiment of the present invention.

The electrode network 10 may be expanded to include a third row of electrodes, so N parallel analyzers may be constructed using only 1.5N+3 electrodes. FIG. 7 is a cross-sectional view of an electrode network 40 according to another embodiment of the present invention. As shown in FIG. 2, with N=8 as an example, electrode network 40 includes 1.5N+3 (e.g., 15) electrodes $e_1, e_2, \ldots, e_{15}$ arranged in three rows each having 0.5N+1 (e.g., 5) electrodes. The three rows of electrodes include a first row 42 having electrodes $e_1, e_2, \ldots, e_5$, a second row 44 having electrodes $e_6, e_7, \ldots, e_{10}$, and a third row 46 having electrodes $e_{11}, e_{12}, \ldots, e_{15}$ Again, every four adjacent electrodes in the electrode network 10 form a trapping volume. For example, electrodes $e_1$, $e_2$, $e_6$, and $e_7$ form a trapping volume $v_1$, electrodes $e_2$, $e_3$, $e_7$, and $e_8$ form a trapping volume $v_2$, electrodes $e_3$, $e_4$, $e_8$, and $e_9$ form a trapping volume $v_3$, electrodes $e_4$, $e_5$, $e_9$, and $e_{10}$ form a trapping volume $v_4$, electrodes $e_6$, $e_7$, $e_{11}$, and $e_{12}$ form a trapping volume $v_5$, electrodes $e_7$, $e_8$, $e_{12}$, and $e_{13}$ form a trapping volume $v_6$, electrodes $e_8$, $e_9$, $e_{13}$, and $e_{14}$ form a trapping volume $v_7$, and electrodes $e_9$, $e_{10}$, $e_{14}$, and $e_{15}$ form a trapping volume $v_8$. Therefore, a two dimensional array of 2×4 parallel ion traps can be constructed using the electrode network 40 including 15 electrodes, as illustrated in FIG. 7.

As also shown in FIG. 7, detectors 28 may be placed on both sides of the electrode network 40 to collect the ions ejected from the respective trapping volumes. One concern with the two dimensional array of ion traps is that ions from one ion trap might mix with ions from an adjacent row of ion traps. However, the ejection may be well controlled by external extraction voltages that ions should leave each analyzer toward the corresponding detector, preventing any cross talk between the two rows of ion traps.

The foregoing descriptions of specific embodiments of the present invention have been presented for purposes of illustration and description. They are not intended to be exhaustive or to limit the invention to the precise forms and procedures disclosed, and obviously many modifications and variations are possible in light of the above teaching. The embodiments were chosen and described in order to best explain the principles of the invention and its practical application, to thereby enable others skilled in the art to best use the teaching and various embodiments with various modifications as are suited to the particular use contemplated. It is intended that the scope of the invention be defined by the claims appended hereto and their equivalents.

The invention claimed is:

1. An electrode network for N parallel linear ion traps, wherein N is an integer larger than 1, characterized in that the electrode network includes at most 2N+2 parallel electrodes forming the radial components of N trapping volumes each corresponding to a respective one of the N parallel linear ion traps.

2. The electrode network of claim 1, wherein the network of electrodes includes exactly 2N+2 electrodes.

3. The electrode network of claim 2, wherein the 2N+2 electrodes are arranged in two rows each having N+1 electrodes.

4. The electrode network of claim 1, wherein N is an even number and the network of electrodes includes exactly 1.5N+3 electrodes.

5. The electrode network of claim 4, wherein the 1.5N+3 electrodes are arranged in three rows each having 0.5N+1 electrodes.

6. The electrode network of claim 1, wherein each of the electrodes is a conductive rod having a cross-section with a substantially round shape on at least one side facing a trapping volume.

7. The electrode network of claims 1, wherein each of the electrodes is a conductive rod having a cross-section with a substantially hyperbolic shape on at least one side facing a trapping volume.

8. A parallel mass spectrometer, comprising: a vacuum chamber; and a network of at most 2N+2 parallel electrodes disposed in the vacuum chamber and held in fixed position with respect to each other, the network of electrodes forming the redial components of N trapping volumes each corresponding to one of N parallel linear ion traps.

9. The parallel mass spectrometer of claim 8, wherein the network of electrodes are arranged in first and second rows of electrodes, and the parallel mass spectrometer further comprises a plurality of detectors positioned to receive ions ejected from the trapping volumes through spaces between adjacent electrodes in the first row of electrodes.

10. The parallel mass spectrometer of claim 8, wherein the network of electrodes are arranged in first and second rows of electrodes, and the N trapping volumes include a first set of trapping volumes and a second set of trapping volumes interleaving with the first set of trapping volumes such that each one of the first set of trapping volumes is separated from another one of the first set of trapping volumes by at least one of the second set of trapping volumes, the parallel mass spectrometer further comprising:

a first group of detectors positioned to receive ions ejected from the first set of trapping volumes through spaces between adjacent electrodes in the first row of electrodes; and a second group of detectors positioned to receive ions ejected from the second set of trapping volumes through spaces between adjacent electrodes in the second row of electrodes.

11. The parallel mass spectrometer of claim 8, wherein the network of electrodes are arranged in first, second, and third rows of electrodes and the trapping volumes include a first set of trapping volumes between the first and second rows of electrodes and a second set of trapping volumes between the second and third rows of electrodes.

12. The parallel mass spectrometer of claim 11, further comprising first and second groups of detectors, the first group of detectors positioned to receive ions ejected from the first set of trapping volumes through spaces between adjacent electrodes in the first row of electrodes, the second group of detectors positioned to receive ions ejected from the second set of trapping volumes through spaces between adjacent electrodes in the third row of electrodes.

13. The parallel mass spectrometer of claim 8, wherein each of the electrodes is a conductive rod having a cross-section with a substantially round shape on at least one side facing a trapping volume.

14. The parallel mass spectrometer of claim 8, wherein each of the electrodes is a conductive rod having a cross-section with a substantially hyperbolic shape on at least one side facing a trapping volume.

15. The parallel mass spectrometer of claim 10 wherein the first and second group of detectors are positioned at opposite sides of the network of electrodes.

* * * * *